United States Patent [19]

Giza et al.

[11] 4,285,783

[45] Aug. 25, 1981

[54] COATING FOR METAL SHELVING AND METHOD OF APPLYING SAME

[75] Inventors: Gerald J. Giza, Wilkes-Barre; John H. Welsch, Moscow, both of Pa.

[73] Assignee: Metropolitan Wire Corporation, Wilkes-Barre, Pa.

[21] Appl. No.: 55,341

[22] Filed: Jul. 6, 1979

[51] Int. Cl.[3] ..... C25D 5/48

[52] U.S. Cl. ..... 204/35 N; 204/38 E; 204/41; 148/6.15 R; 427/410

[58] Field of Search ..... 204/38 R, 38 E, 41, 204/181 R, 35 N; 427/410; 148/6.15 R

[56] References Cited

U.S. PATENT DOCUMENTS

| | | | |
|---|---|---|---|
| 3,480,485 | 11/1969 | Hart et al. | 148/6.15 |
| 3,501,270 | 3/1970 | Uchida et al. | 204/181 R X |
| 3,790,355 | 2/1974 | Palisin, Jr. | 204/38 E X |
| 3,928,157 | 12/1975 | Suematsu et al. | 204/181 R |

FOREIGN PATENT DOCUMENTS

| | | | |
|---|---|---|---|
| 730130 | 3/1966 | Canada | 204/38 E |

OTHER PUBLICATIONS

Metal Finishing Guidebook and Directory, Metals and Plastics Publications, Inc. Hackensack, N.J., pp. 194, 276, 572–575, 641, 652–653.

*Primary Examiner*—Delbert E. Gantz
*Assistant Examiner*—William Leader
*Attorney, Agent, or Firm*—Friedman, Goodman & Teitelbaum

[57] ABSTRACT

A plastic coating for plated metal shelving used in walk-in coolers, and the method of applying the coating to the metal shelving. When the metal shelving is cleaned and prepared for the plating, a nickel film and a chromium film are electrodeposited in that order on the metal shelving in two successive operations. The deposited chromium metal surface is then treated with an iron phosphate in order to enhance the adhesion of a final outer layer of plastic. The iron phosphate treatment is carried out in a three-stage spray washer operation. The coating in the form of an epoxy resin is then applied, where the epoxy resin is preferably a thermosetting plastic of the Bisphenol-A type which requires specific time and temperatures to achieve a proper desired cure and color.

11 Claims, No Drawings

COATING FOR METAL SHELVING AND METHOD OF APPLYING SAME

BACKGROUND OF THE INVENTION

The present invention relates to a coating for metal shelving, particularly to a plastic coating suitable for plated metal shelving for use in walk-in coolers. The invention also relates to a method of applying the coating to the metal shelving and to the coated or finished article itself.

The use of metal shelving generally, and wire shelving specifically in walk-in coolers is well known. Because of the extremely corrosive environment in these walk-in coolers, owners have traditionally found it necessary to choose between costly stainless steel shelving which will resist corrosion and more economical plated carbon steel which has a limited life in such an environment.

A recent development in coatings for metals has been the introduction of plastic powder coatings which are of many types and which are generally applied over unplated metal parts. Some manufacturers of shelving for walk-in coolers have introduced shelving where the plastic coating is applied directly over a zinc-plated substrate.

It must be understood that in actual use in walk-in coolers, shelving is subjected to considerable mechanical abuse; and virtually any coating will begin to chip after a period of time. When this happens, these zinc-epoxy systems are deemed to be deficient in two areas. First, because the plastic coating is opaque, the area where coating has chipped off can be readily seen and gives an objectionable appearance. Secondly, the zinc coating, being sacrificial to steel, begins to oxidize under the coating. As a result, the coating looses adhesion and lifts off in increasing amounts.

SUMMARY OF THE INVENTION

It is therefore an object of the present invention to overcome the above described disadvantages of the prior art by providing a coating for metal shelving which retains the substrate's attractive appearance while meeting all of the requirements of the consumer's protection agencies.

It is another object of the invention to provide a coating for metal shelving which has superior corrosion protection properties because of the dual protection offered by a substrate plating and by an overlying epoxy coating, said coating retaining a tinted transparent characteristic.

It is a further object of the invention to provide a plastic coating for metal shelving which has superior impact resistance to chipping and is capable of evenly flowing into low current density areas while building up the proper desired thickness throughout the metal shelving.

It is still another object of the invention to provide a method for applying the coating to the metal shelving and to provide for a structure having a plastic coating of superior quality.

Briefly stated, after the steel shelving has been thoroughly cleaned and prepared for plating, a nickel film and a chromium film are electrodeposited in that order on the metal substrate, in two successive operations. The first layer has a thickness preferably of about 1 mil while the second or chromium layer has a thickness of preferably about 1/100th of a mil. After the nickel and chromium have been deposited on the metal shelving, the chromium metal surface is treated with an iron phosphate in order to enhance the adhesion of the final outer layer of plastic.

The outer coating of plastic, preferably an epoxy resin, ranges in thickness from about 0.008 to about 0.010 inches, and has a special chemical formulation which is designed to yield a superior impact resistance to chipping, is capable of flowing into low current density areas which have received less plating than the average thickness of the metal shelving, is capable of building up an even and proper thickness throughout the metal shelving, and finally meets all requirements of such agencies as the Food and Drug Administration and others.

After the electrodepositions of the nickel and chromium films have been performed, an iron phosphate treatment is carried out in a three-stage spray washer operation. The treatment is primarily used to enhance the adhesion of the epoxy or plastic coating by cleaning and preparing the chromium surface in a suitable manner. In the first stage, an iron phosphate-detergent mixture is applied to the chromium surface, the detergent component being present as a supplement in the cleaning ability of the phosphate agent. Following a spray cold water rinse as the second stage, the parts are subjected to a hot water rinse.

After drying, the epoxy resin is applied by an electrostatic spray and is then cured by baking. The epoxy is a thermosetting plastic preferably of the Bisphenol-A type, which requires specific time and temperatures to achieve the proper desired cure.

The invention hereinabove briefly stated, together with its objects and advantages, will become more apparent from the following complete and detailed description of preferred embodiments thereof.

DETAILED DESCRIPTION OF THE PREFERRED EMBODIMENTS

Metal shelving structures which are suitable for coating with the composition of the present invention and in accordance with the method of application described herein are, for example, those described and claimed in U.S. Pat. No. 3,523,508 issued to Louis Maslow on Aug. 11, 1970 and incorporated herein by reference.

A typical metal shelving, disclosed in this U.S. Pat. No. 3,523,508 comprises a flat shelf member, four vertical corner posts, attached to frusto-conical receiving and holding sections provided at each corner of the flat shelf and a plurality of horizontally running indentations on each corner post so as to provide adjustable vertical positioning of the metal shelf itself. Obviously, different structures and modifications of metal shelving for use particularly in walk-in coolers may be had without altering the scope and spirit of the invention.

Generally, the material employed in the construction of such metal shelving is steel or other equally strong metal, capable of supporting oftentime elevated loads. Plating of the basic metal structure is also frequently adopted, in order to minimize rusting and other corrosion problems, which are caused, for example, by use and abuse of the metal surfaces through the use of mordants, acids, lyes and the like. In order to minimize these disadvantages, it has recently been advocated to protect the metal surface with an overlying film of plastic material. However, the peculiar mode of utilization of the metal shelving of the present invention does not lend itself to the application of any randomly selected plastic coating.

There are a number of requirements which must be observed in order to obtain a superior and highly satisfactory product, namely: the plastic coating must be adhering to the metal substrate in such a manner as to retain all of the mechanical properties desired; furthermore the article appearance and the performance of the coating must be such as to retain the physical pleasant appearance of a shiny metal-plated shelving without having to replace it with an opaque or dull surface; furthermore the coating must possess such a characteristic as to flow evenly and unimpeded onto all low current density areas so as to build up an even thickness throughout the shelving and consequently retain an even resistance both to corrosion and to impact; and finally, the coating must meet the health requirements set forth in the regulations of Food Control Agencies, besides withstanding the frequent contact with acid or extremely basic cleaning materials.

To carry out the precoating operation, namely the electroplating of the basic steel shelving and to avoid such inferior type of plating as zinc plating, while at the same time retaining a modicum of economy, two successive plating operations are carried out after the steel base has been thoroughly cleaned in conventional and known manners. In the present state of the art of electro metallurgy, nickel plating and chrome plating have reached such a degree of sophistication that films may be deposited uniformly on relatively flat surfaces. However, it still remains relatively difficult to fully plate those recondite recesses in the structure, where a low current density is applied. To apply a higher current density in such places signifies to deposit an excessive layer of metal in the more accessible regions of the shelving, with the resultant increase in manufacturing costs.

A typically preferred approximate thickness of the two layers to be deposited which has been found to meet commercial requirements calls for a 1 mil thickness of nickel (0.001 in.) and a 1/100th of a mil (0.00001 in.) of chromium. The factors involved in the determination of the nature of the nickel and chromium deposits are the composition of the bath and the operating conditions or electroplating parameters. The composition of the nickel bath preferably consists (per gallon of bath solution) of about 35 to 50 oz. of nickel sulfate ($NiSO_4.6H_2O$), 6 to 10 oz. of nickel chloride ($NiCl_2.6H_2O$) and 5.5 to 6.5 oz. of boric acid ($H_3BO_3$). To these basic ingredients it is often customary and advisable to add such additives as brighteners (usually in amounts by volume ranging from 0.05% to 3% and/or wetting agents (in amounts by volume ranging generally from about 0.1 to 0.2%).

The electroplating operating is then carried out usually under Hull cell conditions, which preferably include a cathode current density of about 20 to about 100 amps/ft.$^2$, an anode current density of about 5 to 60 amps/ft.$^2$, a voltage of about 6 to about 18 volts, and a bath temperature of approximately 110 to 155 degrees F. The pH of the bath solution is usually kept in the neighborhood of 3.5 to 4.8, with an optimum value of 41., and the bath is agitated mildly, the nickel being the anodic terminal of the cell.

After the nickel deposition has been completed to a thickness preferably of the order of about 1 mil, a second electrodeposition is effected to lay over the nickel layer a film of chromium of a much smaller thickness (1/100th of a mil). The chromium plating solution is composed basically, per gallon of bath solution, of chromic acid in an amount of about 24 to about 32 oz/per gal., chromium sulfate in an amount of about 0.14 to 0.25 oz/per gal., the weight ratio of $CrO_3$ to $SO_4$ ions being in the range of 130:1 to 150:1.

In order to obtain the proper bath compositions, two ingredients are preferentially used, namely, "MaCrome" salt, manufactured by MacDermid Inc. Chemicals of Waterbury, Conn. in an amount of about 28 oz/gallon of solution and about 0.2 oz. per gal. of solution of a 66 degree Be. Sulfuric Acid. The chrome plating operation is carried out under the following preferred conditions: An average current density of about 40 to 400 amps/ft.$^2$; a voltage of about 3 to 15 Volts; a bath temperature of about 105 to 140 degrees F., with anodes made of a lead-tin alloy.

After the two metal layers have been deposited, the bright chromium electrodeposit is subjected to a phosphate-type treatment, which give rise to improved adhesion of the successive plastic coating. However, it has been found that a particularly satisfactory phosphate treatment can be applied best by utilizing a 3-stage spray washing operation.

In the first stage, a mixture of iron phosphate and detergent is applied to the chromium surface, even though the iron phosphate already contains its own wetting agent for cleaning. However the addition of a detergent of a detergent serves as a supplement in the cleaning operation and to the cleaning ability of the iron phosphate solution. A typically acceptable iron phosphate-detergent combination is a mixture of 1 to 2% by vol. of "Iron Phosphotex 4511" and 0.5 to 3% by vol. of "Iron Phosphotex-detergent 4523", both products being marketed by MacDermid Inc. Chemicals. This treatment is carried out for about one half to one and a half minutes at about 140 to 180 degrees F. under a nozzle pressure of about 15 to 30 p.s.i.g. and at a pH of about 3.0 to 4.5

After the above latter treatment has been completed, the surface is subjected, in the second stage, to a spray cold water rinse and finally a hot water rinse.

After the surface has been prepared for the adhesion of the plastic coating, the final step is effected, namely the coating with a powdered epoxy. This may be applied by an electrostatic spray or by a fluidized bed, and then it is cured by baking the epoxy resin, preferably a thermosetting plastic of the Bisphenol-A type which requires specific time and temperatures to achieve the proper curing and color.

A suitable mixture of this epoxy resin is marketed by the Midland Division of Dexter Corporation of Olean, New York, under the name of "Dri-Dex 99×8006." This is a material of low opacity and of a blue-greenish coloration or tint. It is a Bisphenol-A epoxy with a gel time of 28 seconds at 410 degrees F. and with an average particle size of about 43 microns and a specific gravity of 1.13. It is usually applied by an electrostatic spray, however, a fluidized bed may also be employed, both methods of application being quite conventional and known in the art.

A thickness of application of epoxy resin ranges from about 0.008 to about 0.010 inches, and the curing thereof is done in accordance with the following Table:

| Curing of Epoxy | |
|---|---|
| Temperature (°F.) | Approximate Time (Minutes) |
| 325° F. | 17 min. |
| 350° F. | 12 min. |
| 375° F. | 11 min. |
| 400° F. | 9 min. |
| 425° F. | 8 min. |

In other words, depending on the temperature selected, the curing time will range between 8 and 17 mins. as indicated hereabove. The result of such application has been found to give a highly satisfactory hardness of the order of a 6H Pencil, a gloss of about 100+60 degrees, a good edge coverage, no effect on a conical mandrel, an impact (direct and reverse) of about 160 in lb., no effect after 1000 hours to a 5% salt spray test, carried out in accordance with ASTM B117-64 procedure, no effect after 1000 hours to humidity test at 100% humidity at 96 degrees F., and a very good chemical resistance to acids, alkalis, and petroleum products.

The following example will illustrate, without limiting the scope of the present invention, the process of application of the film to a steel shelving. A nickel plating solution was prepared consisting of, per gal. of solution, 45 oz. of nickel sulfate ($NiSO_4.6H_2O$), 7 oz. of nickel chloride ($NiCl_2.6H_2O$), and 6 oz. of boric acid ($H_3BO_3$). To this solution was added 0.1% by volume of Brightener No. 30H, 1.5% by volume of Brightener No. 14, 2.0% by volume of Brightener No. 33, and 0.15% by volume of Wetting Agent No. 32, the Brighteners and the Wetting Agent being products of MacDermid Inc., Chemicals. The nickel plating bath was carried out at an average cathode current density of 55 amps/ft.$^2$, at a voltage of 5 volts, and at a temperature of about 145 degrees F. Furthermore, the pH was 4.1, the anodes utilized were made of nickel and the plating was carried out with mild air agitation.

A film of about 0.001 in. was uniformly deposited throughout the shelving. Subsequently, the chrome plating operation was carried out by utilizing a bath composition of chromic acid in an amount (per gal. of bath) of 28 oz., chromium sulfate in amount of 0.20 oz. and keeping a ratio of chromate to sulfate of about 140:1. In order to obtain the most satisfactory bath composition, the above ingredients were made up by the following products of MacDermid Inc. Chemicals: 28 oz. of "MaCrome 28 salts" and 0.20 oz. of 66 degree Be. Sulfuric Acid. The Chrome plating operation was carried out at an average current density of 125 amps./ft.$^2$, a voltage of about 4.5 volts, a temperature of 114 degrees F., the anodes being a lead-tin alloy. A very thin layer or film of chromium was deposited on the nickel and was measured to be about 0.000010 in. thick.

After the chromium film was evenly deposited throughout the shelving, the iron phosphate treatment was performed, as discussed above, in a 3 stage spray washer. In the first stage, a mixture of iron phosphate and detergent manufactured and sold by MacDermid Inc. Chemicals was utilized. It consisted of 1.5% by volume of "Iron Phosphotex 4511" and 0.75% by volume of "Iron Phosphotex detergent 4523". This first stage was carried out at 160 degrees F. for 1 min. under a nozzle pressure of about 25 p.s.i. and with a pH of 4.0. Following this treatment, the shelving was spray cold-water rinsed and, afterwards, subjected to a hot water rinse.

At this point, the surface was deemed ready to accept the epoxy coating which consisted of "Dri-Dex 99×8006" of low opacity and a blue-green tint and chemically identifiable as a Bisphenol-A epoxy resin having the following physical characteristics: A gelling time at 410 degrees F. of 28 seconds, an average partical size of 43 microns and a specific gravity of 1.13. This epoxy resin was applied by electrostatic spray, in a conventional manner, to a thickness of 9 mils. (0.009 in.) and then was cured at 350 degrees F. for 12 mins.

A film 9 mil. thick (0.009 in.), having been so deposited on a 24 gauge steel panel was then tested for its performance characteristics. It was found to have a hardness of a 6H pencil, a gloss of 100+60 degrees and a good and satisfactory edge coverage. It was also found to have no effect on a conical mandrel, to resist an impact (direct and reverse) of 160 in.-lbs., and to resist without effect 1000 hours of a 5% salt spray in accordance with the procedure set down in ASTM B117-64. Furthermore, it was found to resist also without effect for 1000 hours an environment of 100% humidity at 96 degrees F., and to have excellent chemical resistance to acids, alkalis and petroleum products.

As to appearance, the coating was found to have a soft, transparent tinge, which allowed the pleasant and elegant appearance of the chromium plating to shine through, while lending all the required protection against corrosion, impact and other chemical and mechanical abuses.

Having so described a particular composition of the invention for coating of metal shelving utilized especially in walk-in-coolers, and having described the method of application of the coating to such shelving, and furthermore having tested the performance of the applied coating itself, the following claims are deemed to be reflective of the above described invention.

What is claimed is:

1. A method of coating a metal shelving, comprising the steps of:

(a) cleaning a metal shelving surface;

(b) electrodepositing, in succession, on said metal surface two metallic layers, the first layer being of nickel and the second layer being of chromium;

(c) treating the thus deposited chromium layer by means to enhance adhesion between the chromium layer and a final outer layer of epoxy resin, said means including:

(i) cleaning the chromium surface with an iron phosphate-detergent mixture;

(ii) spray cold water rinsing the thus cleaned surface; and (iii) subjecting the cold water rinsed surface to a hot water rinse;

(d) applying onto the thus treated chromium layer an epoxy resin of low opacity; and (e) curing the said resin to obtain said coating on said metal shelving.

2. A method according to claim 1, wherein said epoxy resin is applied as a thermosetting plastic.

3. A method according to claim 1, wherein the said nickel layer is deposited to a thickness of about 0.001 inches, and said chromium layer is deposited to a thickness of about 0.00001 inches.

4. A method according to claim 1, wherein said epoxy resin is applied to a thickness of from about 0.008 to about 0.010 inches.

5. A method according to claim 1, wherein the electrodeposition of the nickel layer is effected at a cathode current density of about 20 to 100 amps/ft.$^2$, an anode current density of about 5 to 60 amps/ft.$^2$, a voltage of about 6 to 18 volts, a bath temperature of about 110° to 155° F. a pH of about 3.5 to 4.8; from a solution comprising, per gallon of solution: about 35 to 50 oz. of nickel sulfate, about 6 to 10 oz. of nickel chloride, about 5.5 to 6.5 oz. of boric acid, together with brighteners and/or wetting agents.

6. A method according to claim 1, wherein the electrodeposition of the chromium layer is effected at a cathode current density of about 40 to 400 amps/ft.$^2$, at a voltage of about 3 to 15 volts, at a bath temperature of about 105° to 140° F.; from a solution comprising, per gallon of solution: about 24 to 32 oz. of chromic acid, about 0.14 to 0.25 oz. of chromium sulfate; the ratio of the chromate ion to the sulfate ion being in the range of 130:1 to 150:1.

7. A method according to claim 1, wherein the iron phosphate-detergent mixture consists of 1.5% by volume of iron phosphate and 0.75% by volume of detergent.

8. A method according to claim 1, wherein said cleaning of the chromium surface is effected at a temperature of about 140° to 180° F. for about 30 to 90 seconds under a nozzle pressure of about 15 to 30 p.s.i.g. and at a pH of about 3.0 to 4.5.

9. A method according to claim 2, wherein said thermosetting plastic has a gelling time of 28 seconds at 410° F., has an average particle size of 43 microns and a specific gravity of 1.13.

10. A method according to claim 2, wherein said thermosetting plastic is applied by electrostatically spraying it onto the receiving substrate surface.

11. A method according to claim 1, wherein said spray epoxy resin is applied as a Bisphenol-A resin.

* * * * *